United States Patent [19]

Palmquist

[11] Patent Number: 4,846,090

[45] Date of Patent: Jul. 11, 1989

[54] BOAT MOORING DEVICE

[76] Inventor: Terrence L. Palmquist, 6805 Sheridan Ave. S., Richfield, Minn. 55423

[21] Appl. No.: 174,102

[22] Filed: Mar. 28, 1988

[51] Int. Cl.[4] ..... B63R 21/04

[52] U.S. Cl. ..... 114/230; 114/254; 242/107.4 R

[58] Field of Search ..... 114/230, 254; 242/86.5 R, 86.5 A, 107, 107.4 R

[56] References Cited

U.S. PATENT DOCUMENTS

| | | | |
|---|---|---|---|
| 829,869 | 8/1906 | Hopkins | 242/107 |
| 856,684 | 6/1907 | Dittman | 242/107.4 |
| 1,811,400 | 6/1931 | McClellan | 114/230 |
| 2,217,323 | 10/1940 | Sackett | 242/107.8 R |
| 2,394,523 | 2/1946 | Pancoe | 242/107.4 R |
| 2,952,238 | 9/1960 | Barber | 116/101 |
| 3,012,736 | 12/1961 | Brust | 114/230 X |
| 3,020,567 | 2/1962 | Colt | 242/107 |
| 3,242,895 | 3/1966 | Hornby | 114/254 |
| 3,614,016 | 10/1971 | Rieth | 242/106 |
| 3,645,468 | 2/1972 | Edelberg et al. | 242/107 R |
| 3,851,613 | 12/1974 | Armour | 114/230 |
| 4,407,460 | 10/1983 | Khudaverdian | 242/86.5 A |

*Primary Examiner*—Sherman D. Basinger
*Attorney, Agent, or Firm*—Dorsey & Whitney

[57] ABSTRACT

A boat mooring device capable of storing and dispensing a rope used to moor a boat or the like is disclosed. A spring biased reel assembly carrying a rope is rotatably mounted within a case. The reel assembly is urged by the spring in a rope take-up direction. A lock assembly selectively inhibits rotation of the reel assembly in a rope pay-out direction. A unique rope guidance system facilitates the withdrawal of rope from, and retraction of rope into, the device.

5 Claims, 2 Drawing Sheets

BOAT MOORING DEVICE

TECHNICAL FIELD

This invention relates to a boat mooring device. More particularly, it pertains to a device capable of storing and dispensing variable lengths of rope used to maintain a vessel in a fixed position relative to another object such as a dock, a pier, or another vessel.

BACKGROUND OF THE INVENTION

Typically a boat is secured in a stationary position by tying the frame of the boat to a fixed mooring facility such as a dock or pier. The boat must be equipped with a sufficient length of rope to enable the boat to be secured under a variety of mooring conditions. Such factors as the proximity and dimensions of the mooring facility will determine the length of rope required to secure the boat in a given situation. The length of the rope must be adjustable based upon the requirements imposed by a wide variety of mooring conditions. Rope which is not being used to secure the boat should be stowed on board the boat in a neat and orderly fashion. A rope which is kept coiled or loosely stored in the bottom of the boat may become knotted and/or entangled with passengers, cargo and other equipment on board the boat. A device which could be affixed to a boat and which was capable of storing a sufficient quantity of rope and dispensing the rope in variable lengths would be a decided advantage.

SUMMARY OF THE INVENTION

The boat mooring device in accordance with the present invention provides a convenient, compact and effective means of storing and dispensing rope used to secure a boat in a stationary position. The device is attached to the boat and includes a springloaded spool containing a rope. When the rope is not in use, it is wound neatly around the spool within the device. Variable lengths of rope can be dispensed from the device depending upon mooring conditions. When detached from the mooring facility the rope is retracted into the device and stored on the spool for future use.

DETAILED DESCRIPTION OF THE DRAWINGS

Figure 1:
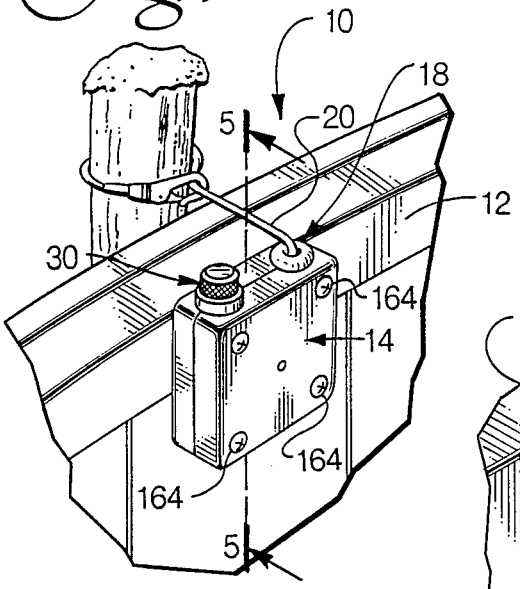
FIG. 1 is a perspective view of a boat mooring device in accordance with the present invention showing one method of attachment of the device to the gunwale of a boat.

Referring to the drawings, a boat mooring device 10 in accordance with the present invention is depicted mounted to the gunwale 12 of a boat. The device broadly includes a case 14, a reel assembly 16, a fairlead assembly 18, a rope 20, a spring latch 22, guide members 26, 28, and a lock assembly 30.

Figure 3:
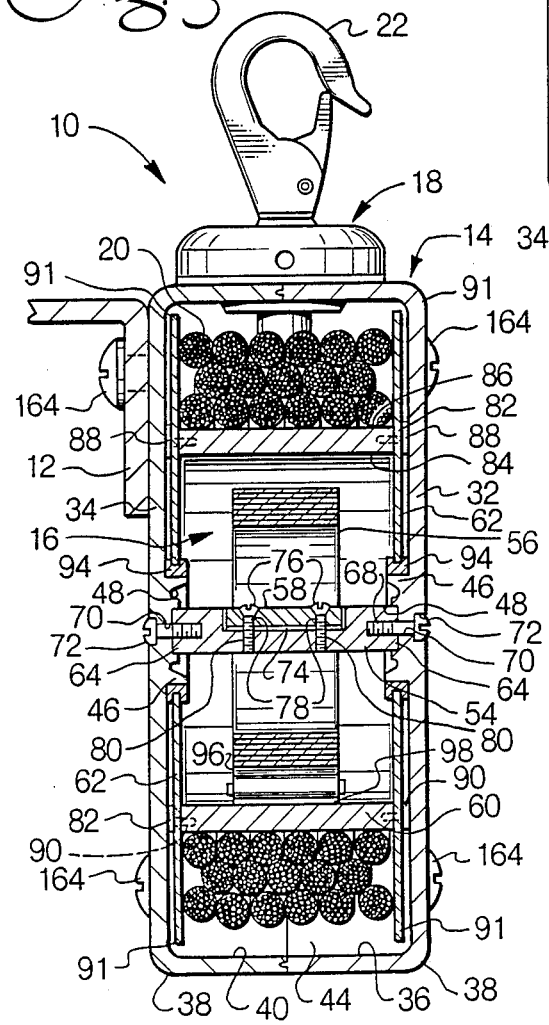
FIG. 3 is a sectional view of the boat mooring device taken along the line 3—3 of FIG. 2.
Figure 4:
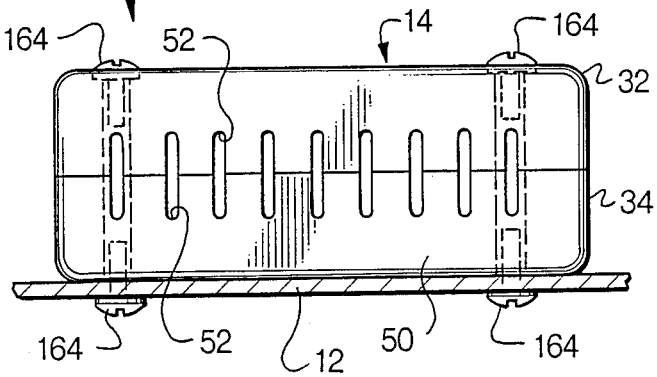
FIG. 4 is a bottom view of the device showing the method of attachment depicted in FIG. 1.

Referring to FIG. 3, the case 14 includes a front cover 32 and a rear cover 34. The front cover 32 has an internal surface 36 and an external surface 38, and the rear cover 34 has an internal surface 40 and an external surface 42. The internal surfaces 36, 40 define a chamber 44. The internal surface of each cover includes a thickened hub portion 46, and a square in cross section cavity 48 within the hub portion 46. Referring to FIG. 4, the bottom surface 50 of the case 14 includes a plurality of drainage slots 52.

Reel assembly 16 broadly includes a center most spring securing member 54, a coil spring 56, a coil spring retaining clamp 58 matingly received by the spring securing member 54, and a cylindrical spool 60 having opposed, annular guide walls 62. The square in cross section opposed ends 64, 66 of spring securing member 54 are complimentarily received within the cavities 48 of the thickened hub portions 46 of the front cover 32 and rear cover 34. Threaded axial channels 68 are bored into the opposed ends 64, 66 of the spring securing member 54. Centered, bored through channels 70 extend through the front cover 32 and rear cover 34 into respective cavities 48. A screw 72 is received through each bored through channel 70, and is threadably received within a respective axial channel 68 for fixedly securing the spring securing member 54 within the cavities 48 of hub portions 46.

The inner bitter end 74 of the coil spring 56 is fixedly, detachably received by spring securing member 54 and coil spring retaining clamp 58. Screws 76 extend through channels 78 in the coil spring retaining clamp 58, through holes in the coil spring inner bitter end 74, and are threadably received within cavity channels 80 of spring securing member 54.

Cylindrical spool 60 includes annular side surfaces 82, internal surface 84, and external surface 86. Annular guide walls 62 are secured to spool 60 by screws 88 extending through channels 90 in the guide walls 62. The screws 88 are threadably received within cavities 92 in the side surfaces 82 of the spool 60. Ratchet teeth 91 line the outer edges of guide walls 62. Circular bearings 94 received by guide walls 62 rotatably mount the spool 60 on the hub portions 46 of the front cover 32 and rear cover 34. The outer terminal end 96 of the coil spring 56 is pivotally attached to fitting 98. The fitting 98 is fixedly attached to the internal surface 84 of spool 60. Rope 20 is carried by the external surface 86 of spool 60. The rope 20 is confined to the spool 60 by the guide walls 62.

Figure 6:
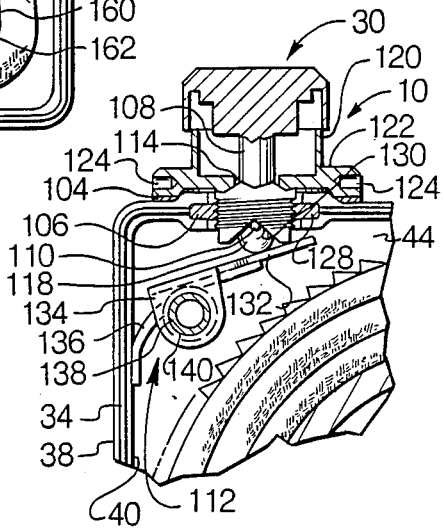
FIG. 6 is a fragmentary, sectional, enlarged view depicting the lock assembly, shear lever and ratchet depicted in FIG. 5.

Lock assembly 30 broadly includes a rotatable cap 100, a lock assembly retaining nut 102, a spacer washer 104, an annular insert seal 106, actuating finger 108 fixedly attached to cap 100, locking cross pin 110 and pawl assembly 112. The actuating finger 108 extends downwardly through a centered channel 114 in lock assembly retaining nut 102. Locking cross pin 110 is carried by channel 116, above the tip 118 of actuating finger 108. Lock assembly retaining nut 102 includes a cylindrical cap guide 120 extending upwardly from and oriented perpendicular to the upper surface 122 of lock assembly retaining nut 102. Tightening holes 124 are positioned opposite one another in the sides of lock assembly retaining nut 102. Spacer washer 104 is positioned between the upper surface of case 14 and lower surface of lock assembly retaining nut 102. Shaft 126 of lock assembly retaining nut 102 is threadably received through insert seal 106 which is contained within annular cavity 128. As depicted in FIG. 6, locking crosspin 110 is received within inverted V-shaped notch 130 when finger 108 is in a fully upward position.

Pawl assembly 112 includes a shear lever 132, attachment member 134, and torsion spring 136. Shear lever 132 is fixedly coupled to attachment member 134 which in turn is pivotally carried by spacer sleeve 138. Torsion spring 136 abuts the internal surface 40 of rear cover 34, loops around the outer surface 140 of spacer sleeve 138, and ultimately abuts the lower surface of shear lever 132. The tip 118 of actuating finger 108 abuttingly engages the upper surface of shear lever 132.

Fairlead assembly 18 includes a fairlead nut 142, a spacer washer 144, and an annular insert seal 146. The inner surface 148 and top surface 150 of the fairlead nut 142 are smooth and curved. The rope 20 exits the chamber 44 of the device 10 through the centered aperture 152 of the fairlead nut 142. Tightening holes 154 are positioned opposite one another in the sides of fairlead nut 142. Fairlead nut shaft 156 is threadably received through insert seal 146 which is contained within annular cavity 158. Spacer washer 144 is positioned between the upper surface of the case 14 and lower surface of the fairlead nut 142.

Figure 5:
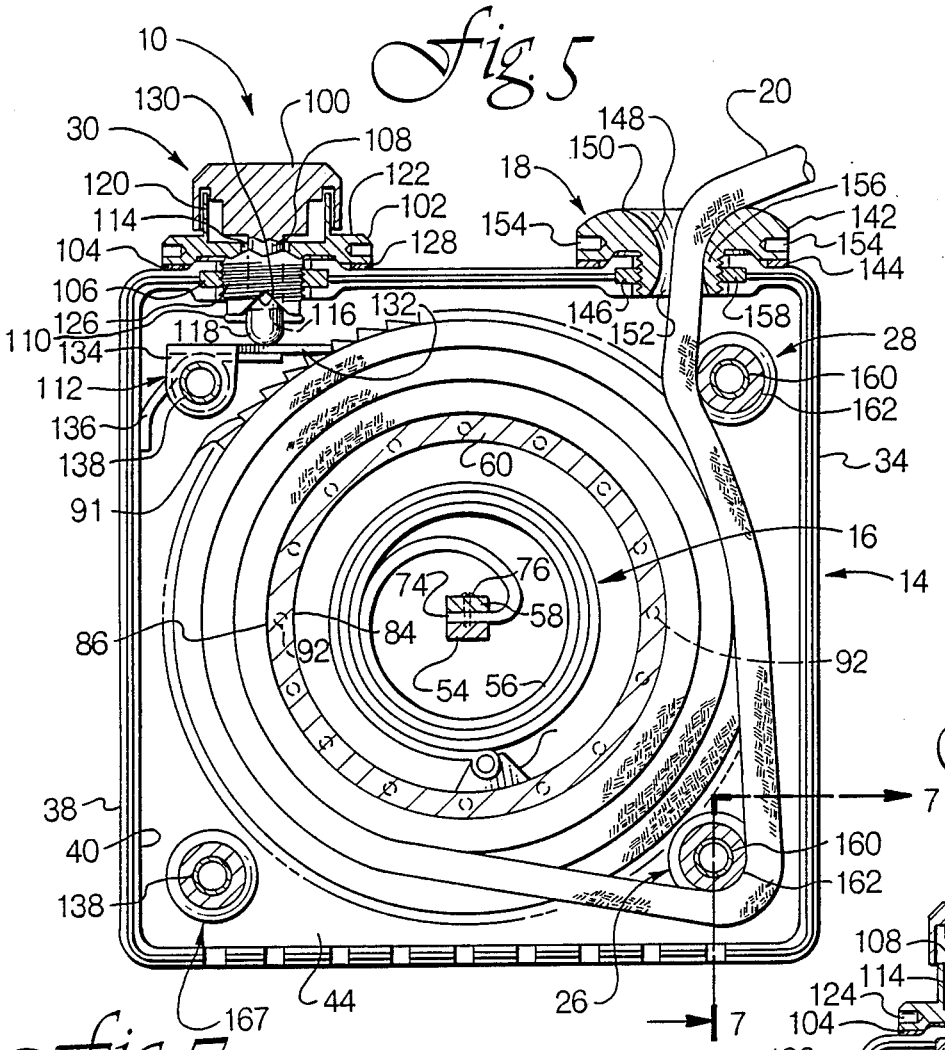
FIG. 5 is a sectional view of the device taken along line 5—5 of FIG. 1.
Figure 7:
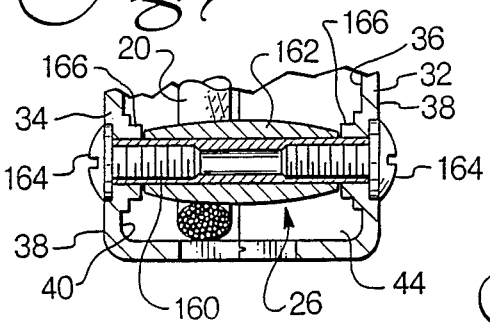
FIG. 7 is a fragmentary sectional view taken along line 7—7 of FIG. 5.

FIG. 5 depicts the orientation of guide members 26, 28. Referring to FIG. 7, each guide member 26, 28 includes a sleeve member 160, a roller 162, and threaded screws 164. Each end of each sleeve member 160 is received within a respective tiered support member 166 integrated with and extending inwardly from the internal surfaces 36, 40 of the front and rear covers 32, 34. Screws 164 are received through the front and rear covers 32, 34 and are threadably carried by respective sleeve member 160. Each sleeve member 160 carries a roller 162. Each roller 162 is free to rotate around its sleeve member 160. Although FIG. 5 depicts each guide member 26, 28 as including a roller, it will be appreciated that the roller associated with guide member 28 could be omitted.

Guide member 26 is positioned opposite attachment member 134 along the diameter of reel assembly 16. Guide members 26, 28 are positioned along a line running parallel to the axis defined by aperture 152. Rope 20 unwinds from the bottom of reel assembly 16 and is guided around guide members 26, 28 before exiting the device 10 through aperture 152. Corner attachment assembly 167 including spacer sleeve 138 is positioned opposite guide member 28 along the diameter of reel assembly 16.

Figure 2:
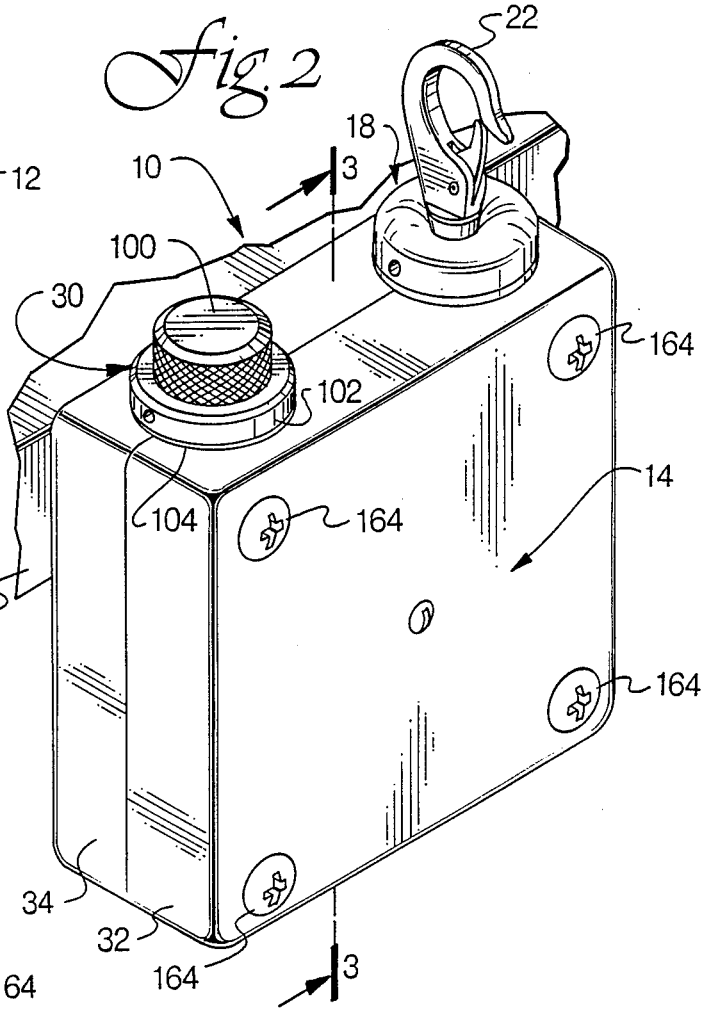
FIG. 2 is a perspective view of the boat mooring device.
Figure 8:
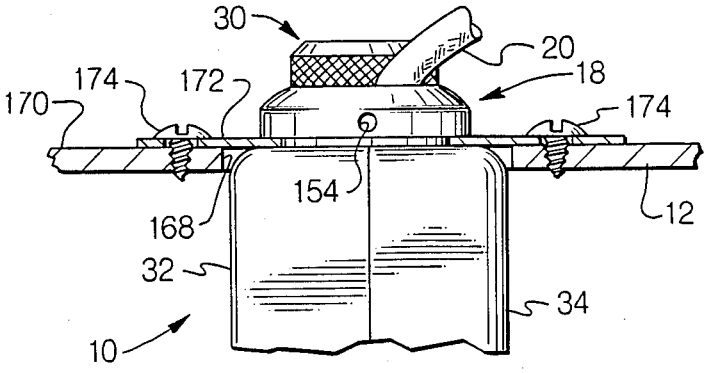
FIG. 8 is a fragmentary side view of the device showing an alternative method of attachment of the device to the gunwale of a boat.

FIG. 8 illustrates an alternate method of attachment of the device 10 to the gunwale 12 of the boat. The case 14 is received through a rectangular opening 168 in the top surface 170 of the gunwale 12. A rectangular plate 172 dimensionally larger than the rectangular opening 168 is coupled to the top surface 170 of the gunwale 12 by threaded screws 174. The fairlead assembly 18 and lock assembly 30 are received though apertures (not shown) in plate 172, thereby connecting case 14 to the plate 172. Plate 172 replaces the spacer washers 144 and 104 described in connection with the first embodiment depicted in FIG. 2.

In operation, rope 20 is dispensed from the boat mooring device 10 by first rotating the cap 100 of lock assembly 30 ninety degrees from the position depicted in FIG. 5, thereby allowing the shear lever 132 to be disengaged from ratchet teeth 91 as is depicted in FIG. 6. The spool 60 is then free to rotate in a counterclockwise direction, from the perspective of FIG. 5, and rope 20 can be manually withdrawn from the device 10. Once a sufficient length of rope has been dispensed, the cap 100 is depressed and returned to the position depicted in FIG. 5, thereby engaging shear lever 132 in ratchet teeth 91 and preventing further rotation of the spool 60 in a rope pay-out direction. The boat is secured in place by looping the rope 20 around a fixed object on the mooring facility and attaching the spring latch 22 to the rope 20.

The rope 20 is retracted into the device by disconnecting the spring latch 22 and rotating the cap 100 to the position depicted in FIG. 6, thereby disengaging the shear lever 132 from the ratchet teeth 99. The coil spring 56 urges the spool 60 in a clockwise direction from the perspective of FIG. 5, thereby automatically retracting the rope 20 into the device 10.

Rollers 162 and smooth, curved fairlead nut inner surface 148 and top surface 150 reduces friction and rope wear, permitting rope 20 to be smoothly and easily dispensed from and retracted into the device 10. Rope 20 is prevented from becoming wedged between the covers 32, 34 and rollers 162 by tiered support members 166. Drainage slots 52 permit moisture that has entered the cavity 44 to drain out through the bottom of case 14.

I claim:

1. An apparatus for storing and dispensing rope used to moor a boat or the like, comprising:

a case including structure defining a rope receiving aperture:

a reel assembly rotatably mounted within said case for windably storing said rope, said reel assembly including a spool having an external, rope supporting surface, a pair of opposed guidewalls operably coupled to said spool, each of said guidewalls having an outside edge line with ratchet teeth, and circular bearings received by said guidewalls for rotatably mounting said reel assembly within said case;

biasing means operably coupled to said reel assembly for urging rotation of said reel assembly in a first, rope take-up direction;

locking means selectively operably engagable with said reel assembly for selectively preventing rotation of said reel assembly in a second rope pay-out direction; and guiding means for guiding said rope into said case and on to said reel assembly when said reel assembly is rotated in said first direction, and off of said reel assembly and out of said case when said reel assembly is rotated in said second direction, said aperture defining a center axis, said guiding means including alignment means for aligning said rope generally along said center axis as it approaches said aperture from within said case.

2. The invention as claimed in claim 1, said alignment means including a plurality of guide members contained within said case, said guide members being positioned along a line parallel to said center axis.

3. The invention as claimed in claim 2, said guide members being oriented with respect to said reel assembly such that the path of travel of said rope within said case is guided by said guide members through at least two nonaligned, generally linear segments.

4. The invention as claimed in claim 2, each of said guide members including a rotatable roller having a generally cylindrical rope support surface, said roller being symmetrically tapered in diameter from wide to narrow from the midpoint thereof to the opposed ends thereof.

5. The invention as claimed in claim 1, said locking means including a pawl shiftable between a first, ratchet-engaging position whereby rotation of said reel assembly in said first direction is permitted but rotation of said reel assembly in said second direction is inhibited, and a second ratchet-clearing position whereby said reel assembly is free to rotate in both said first direction and said second direction, and means for shifting said pawl between said first position and said second position.

* * * * *